United States Patent [19]

Jaumann

[11] Patent Number: 4,655,802

[45] Date of Patent: Apr. 7, 1987

[54] HEAT EXCHANGER FOR A FURNACE USING HEAT OF EXHAUST GAS

[76] Inventor: Alfons Jaumann, Haus Nr. 98, 7450 Hechingen-Bechtoldsweiler, Fed. Rep. of Germany

[21] Appl. No.: 601,151

[22] Filed: Apr. 16, 1984

[30] Foreign Application Priority Data

Apr. 23, 1983 [DE] Fed. Rep. of Germany ..... 3314757

[51] Int. Cl.[4] ..... B01D 53/04

[52] U.S. Cl. ..... 55/208; 55/387; 165/10; 423/244

[58] Field of Search ..... 55/73, 208, 387; 165/10; 423/244 R, 244 A

[56] References Cited

U.S. PATENT DOCUMENTS

| | | | |
|---|---|---|---|
| 2,706,109 | 4/1955 | Odman | 165/10 X |
| 2,905,523 | 9/1959 | Houdry et al. | 423/247 X |
| 3,203,472 | 8/1965 | Brandt | 165/10 |
| 3,276,186 | 10/1966 | Hronas et al. | 55/73 X |
| 3,589,863 | 6/1971 | Frevel et al. | 55/73 X |
| 3,883,326 | 5/1975 | Wenner | 55/73 X |
| 4,003,979 | 1/1977 | Kanno | 423/247 X |
| 4,177,158 | 12/1979 | Blue | 55/73 X |
| 4,451,435 | 5/1984 | Holter et al. | 423/244 R X |
| 4,467,785 | 8/1984 | Langford et al. | 165/10 X |
| 4,497,361 | 2/1985 | Hajicek | 165/10 X |

*Primary Examiner*—Robert Spitzer
*Attorney, Agent, or Firm*—Michael J. Striker

[57] ABSTRACT

A heat exchanger using heat of exhaust gas has a housing, through which the exhaust gas passes, and is provided with a heat storage insert positioned in the housing. Tubes containing air or water receiving heat from the exhaust gas are also located within the housing. The heat storage insert is formed of a plurality of bricks having hollows which form passages for the exhaust gas. The bricks at least in the regions of the passages are formed of a material which adsorbs surfur compounds contained in the exhaust gas.

20 Claims, 10 Drawing Figures

Fig. 3
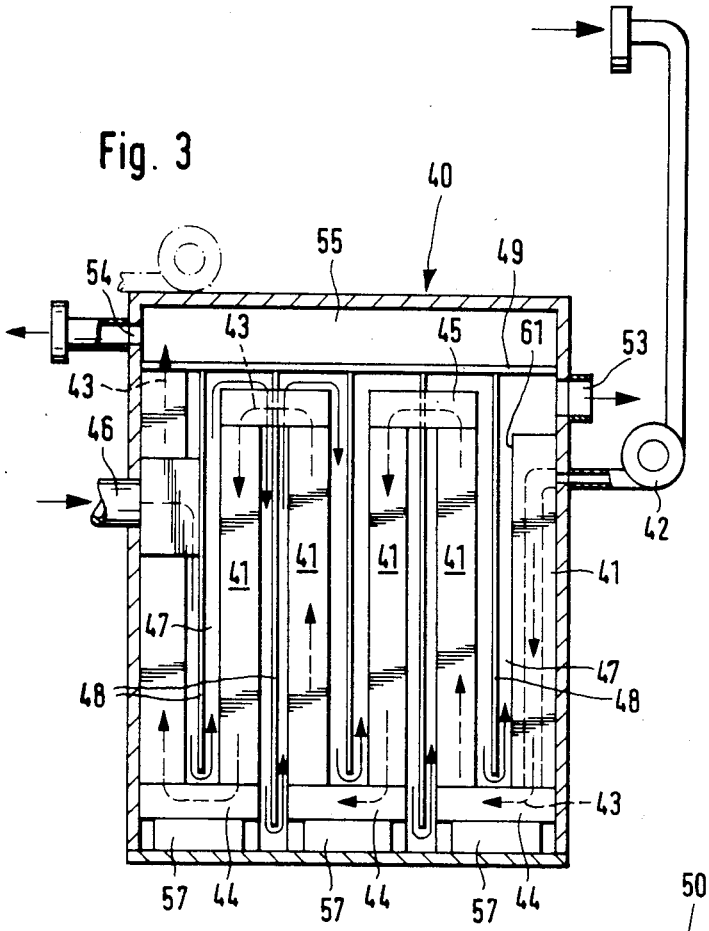
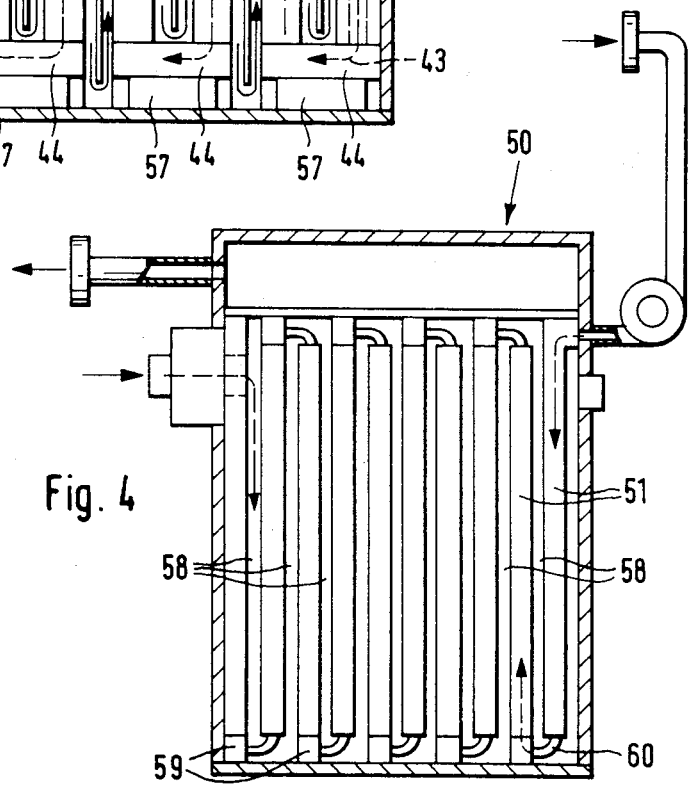
Fig. 4

HEAT EXCHANGER FOR A FURNACE USING HEAT OF EXHAUST GAS

BACKGROUND OF THE INVENTION

The present invention pertains to a heat exchanger for a furnace installation which employs sulfur-containing fuel. Heat exchangers of the type under discussion have been known in the art. The heat exchangers of the foregoing type employ an exhaust gas flowing therethrough and have at least one heat-storing insert member in which passages for a medium receiving heat from the exhaust gas are provided.

Heat exchangers utilizing heat of the exhaust gas have been known, which have been combined with heating boilers. Such a heat exchanger can also be connected to an already available furnace installation, particularly a central heat system. The use of such a heat exchanger reduces losses of exhaust gases. When the heat exchanger is in operation a portion of the heat of exhaust gases is stored; this is particularly advantageous with intermittently operative furnaces because the heat storage insert members at times when the furnace is not operative further warms up the medium receiving the heat, whereby a uniform heat removal from the heat exchanger is obtained and an undesired condensation of a corrosive exhaust gas component can be suppressed.

An increasing environment contamination makes it necessary to decrease the amounts of damaging materials issued from the heating units of the furnace.

SUMMARY OF THE INVENTION

It is an object of the present invention to provide an improved heat exchanger of the foregoing type.

It is another object of the present invention to provide a heat exchanger which would lead to a substantial decrease of issuance of damaging materials during the operation of the furnace.

These and other objects of the invention are attained by a heat exchanger for a furnace using sulfur-containing fuel, comprising a housing having an inlet for feeding hot exhaust gas into the housing and an outlet for discharging the exhaust gas from the housing; said housing defining a cavity through which the exhaust gas passes; at least one heat storage insert positioned in said cavity for storing and yielding heat received from the exhaust gas; means positioned in said cavity and containing fluid medium receiving heat from the exhaust gas and conducting said heat, said inlet being connected to an exhaust gas source and having a cross-sectional area, said heat storage insert being formed with a plurality of through passages for passing the exhaust gas therethrough, said passages having a total cross-section area which is greater than the cross-sectional area of said inlet, said heat storage insert at least in the region of said passages being formed of a material which adsorbs surfur compounds of the exhaust gas at relatively low temperatures.

Thereby the proposed construction ensures that damaging sulfur compounds contained in exhaust gas received from the discharge of the boiler are predominantly adsorbed.

The heat storage insert may be entirely formed of the material which adsorbs sulfur compounds of the exhaust gas at relatively low temperatures.

The heat storage insert may be only coated in the region of said passages with the material which adsorbs sulfur compounds of the exhaust gas at relatively low temperatures.

The heat storage insert may be formed of a plurality of individual blocks assembled into a structural system.

The heat storage insert may be assembled from bricks having hollows.

The bricks may be manufactured of clay, or sand-lime brick, or gas concrete, or pumice, or expanded clay or crushed limestone, or lime granulate, or of any combination of the above materials which adsorb a large portion of mineral acid steam contained in the exhaust gas slowly passing through the hollows or passages of the bricks and through the channels between the bricks within the cavity of the housing. The adsorption action of the bricks can be also enhanced by a filter layer provided on the surface of the heat storage insert, the filter layer additionally adsorbing the sulfur compounds of the exhaust gas and filtering a dust portion of the exhaust gas passing through said passages. This filter layer can be formed, for example by coke packing through which the exhaust gas must pass.

The heat storage insert of the heat exchanger according to the invention permits for various constructions and various dimensions of heat exchanger due to the possibility to select any number of individual blocks or bricks as well as adsorption capabilities of the individual blocks or bricks. The heat exchanger according to the invention can be also readily adjusted to furnaces of various sizes. The material consumption in the present heat exchanger is insignificant. Therefore the heat exchanger can be inserted into the heating system. The heat storage insert can be readily interchanged if necessary for a service or after sooting of its adsorption surfaces. Moreover, only parts of the heat storage insert can be interchanged when necessary.

Owing to the proposed heat exchanger sulfur compounds contained in exhaust gas will be mostly adsorbed; the temperature of the exhaust gas passing through the heat exchanger which is higher than usual, which is under 100° C. will be reduced due to the use of condensation heat; the possibility of sootness of the chimney, through which the exhaust gas is discharged, will be also reduced.

The heat exchanger according to the present invention also provides for the use of a portion of the exhaust gas heat in connection with the storage of the heat obtained by adsorption of the sulfur compounds on the surfaces of the heat storage insert because the adsorption or absorption material substantially reduces the temperature of exhaust gas passing therethrough as compared to the conventional temperatures and also reduces the content of dust in the exhaust gas.

Each of the bricks may be formed with said passages for the exhaust gas and with additional passages for the fluid medium receiving heat from the exhaust gas and conducting the heat.

The heat exchanger may further include plug-in connecting bridge elements for connecting individual blocks to each other.

The heat exchanger may further include a dust collecting chamber formed at a bottom of the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is a schematic view through the heat exchanger according to a third embodiment of the invention;

FIG. 4 is a schematic view of the heat exchanger of a fourth embodiment of the invention;

DETAILED DESCRIPTION OF THE PREFERRED EMBODIMENTS

Figure 1:
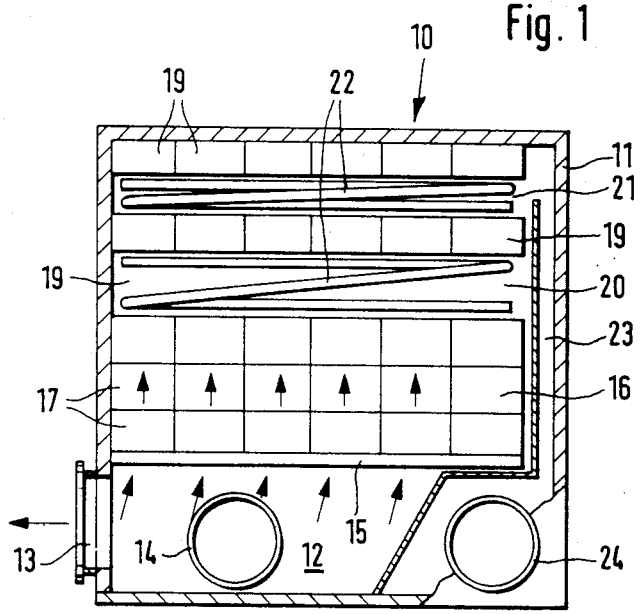
FIG. 1 is a schematic view of the central elongated portion of the heat exchanger according to a first embodiment of the invention.

Referring to the drawings in detail, and first to FIG. 1, reference character 10 denotes a heat exchanger. The heat exchanger according to the invention can be of any size and shape depending on space available at the heat boiler in the heating installation. The shape of the heat exchanger is adjusted to the construction of the heating installation and may have a rectangular or round cross-section. The drawings illustrate the heat exchanger schematically and the heat exchangers shown are only selected examples. Such a heat exchanger is normally secured to the heating space wall or to the heating boiler.

Figure 1A:
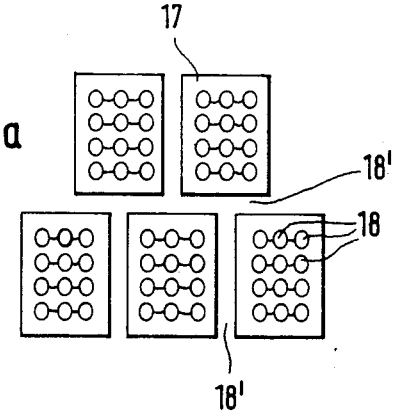
FIG. 1*a* is a partial top plan view of a hollow brick-formation which forms a heat storage-insert member of the heat exchanger.

Heat exchanger 10 shown in FIG. 1 has a housing 11 formed, for example of stainless steel, and subdivided into a plurality of individual regions. A dust collector chamber 12 is formed in the lower region of the heat exchanger. Chamber 12 has an exhaust gas inlet connection member 13 which is connected to the exhaust gas discharge connection of the non-illustrated heating boiler. The dust collecting chamber 12 is accessible through a cleaning opening 14 which is normally closed by any suitable lid. The upper level of dust collecting chamber 12 is limited by a supporting frame 15 on which a heat storage-insert member 16 formed of a plurality of individual superimposed stacked hollow bricks 17 is mounted. FIG. 1*a* illustrates a portion of the brick formation comprised of a number of mutually spaced bricks 17 arranged with interstices therebetween to form through passages 18'. Bricks 17 having hollows form in the insert member 16 vertically directed through passages 18, through which the exhaust gas can flow from the dust collecting chamber 12 into the upper region of housing 11. Additional two heat storing members 19 arranged one above the other subdivide the upper region of the heat exchanger into two separate chambers 20 and 21 in which tube turns 22 only schematically illustrated herein, are located. A return water of the non-illustrated heating water central heat installation or custom water for carrying off the heat of the exhaust gas is fed through tube turns 22. The exhaust gas is fed from the upper chamber 21 into a passage 23 extended along the lateral inner side wall of housing 11 over the entire width thereof and flows downwardly towards the exhaust gas discharge opening 24.

Housing 11 is provided at its side wall in the middle region with a non-illustrated opening which is normally closed with a door or flap. If necessary a new insert member 16 in place of the old one can be inserted through that opening.

Figure 2A:
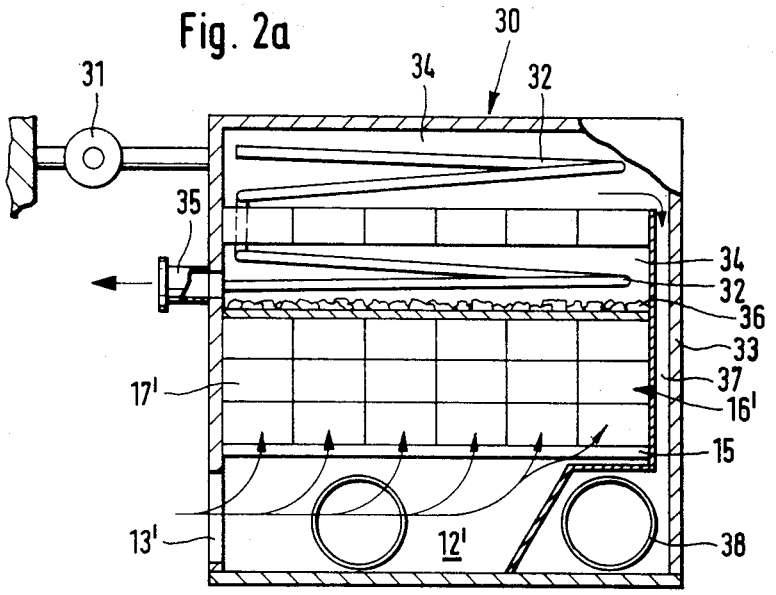
FIG. 2*a* is a schematic view of the central portion of the heat exchanger of the second embodiment of the invention.
Figure 2B:
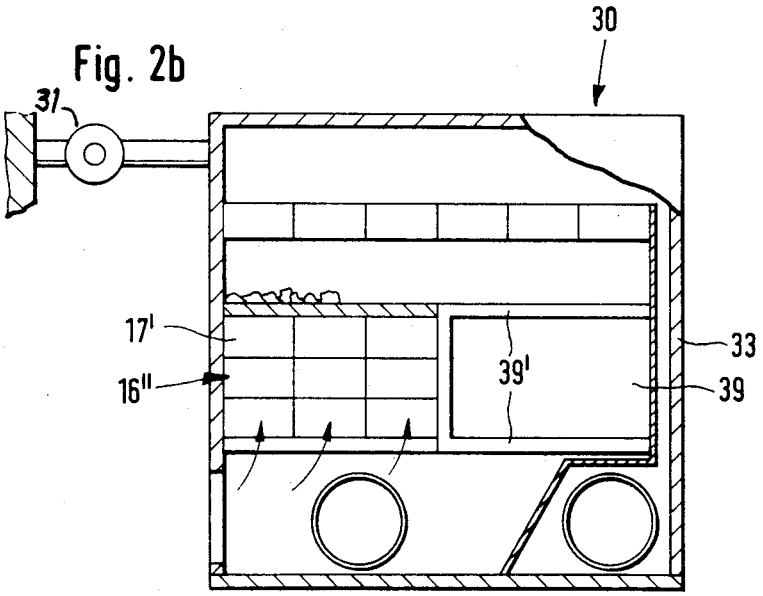
FIG. 2*b* is the view similar to FIG. 2*a* but with the heat storage insert member of the size twice reduced as compared to that of FIG. 2*a;*

With reference to FIGS. 2*a* and 2*b* it may be observed that the heat exhanger 30 has a construction similar to that of FIG. 1. This heat exchanger, however, has at least one blower 31 which blows air for heating the room through tubes or metal hoses 32. Tubes 32 are subdivided in the upper region of housing 33 into two chambers 34 for the exhaust gas. The air discharge connection is designated by the reference numeral 35. The lower half of housing 33 is provided, in the same fashion as the construction of FIG. 1, with a plurality of individual bricks or briquettes which have hollows and which altogether form a heat storage-insert member 16' which is mounted on the supporting frame 15' above the dust collecting chamber 12'. The exhaust gas passes from the inlet opening 13' through the hollow building blocks or briquettes of the heat storage-insert member 16' and through a filter coating or layer 36 of coke, provided on the upper side of insert member 16', into the chambers 34 of the heat exchanger. Exit of the exhaust gas from the uppermost chamber 34 takes place again over the entire width of the side wall through an outlet passage 37 to a discharge opening 38 formed at the lower region of housing 33.

The heat exchanger 30 shown in FIG. 2*b* is suitable for a relatively small boiler. In this case the combined cross-section of the exhaust gas passages and the volume of the heat storage are practically halved by halving the size of the heat storage-insert member 16''. If in the embodiment of FIG. 2*a* the exhaust gas passes altogether through six columns of corresponding three hollow briquettes or hollow bricks 17' in the case of the heat storage insert member 16'' the exhaust gas flows through only three columns or passages of hollow briquettes or bricks 17'. The construction of FIG. 2*b* can be merely formed by removing a number of hollow bricks from the construction of FIG. 2*a*. The free space 39 can be then filled with a wall structure 39' to prevent escape of the exhaust gas from the insert member 16''.

Hollow bricks 17, 17' utilized in the heat exchangers 10 and 30 are manufactured from clay or sand-lime brick. Both materials can adsorb a considerable portion of sulfur compounds contained in the exhaust gas. It is, of course, understandable that the heat storage-insert member can be made of other materials which cause adsorption of sulfur compounds, however most of such other materials are expensive. In order to considerably decrease the contamination of environment with a desired mass inserted into the heat-storage member it is also important to keep the price of such a heat-storage member as low as possible.

Figure 4A:
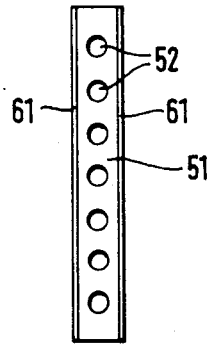
FIG. 4*a* is a top plan view of a building block of the heat storage-insert member.

FIG. 3 illustrates a schematical view through a heat exchanger 40 which also serves for heating a room air by the heat of the exhaust gas. In the construction shown in FIG. 3 a plurality of vertical plate-shaped ceramic elements 41 are arranged in spaced relation to each other. Plate-shaped elements 41 can be assembled from a plurality of individual bricks or blocks and form in the assembled condition the heat-storage insert member. FIG. 4*a* shows an individual ceramic element 51 provided with a plurality of openings or passages 52. Plate-shaped elements 41 are also formed with the passages similarly to those shown in FIG. 4*a*. At least one blower 42 is provided, which blows air for heating the room through the passages in plate-shaped elements 41. Passages 52 are not seen in FIG. 3, however the path of travel of the air is shown by arrows 43. These arrows indicate that air passes through the ceramic bricks, which are alternatingly connected to each other by lower connecting bricks 44 or upper connecting bricks 45 shown individually in FIG. 6. The exhaust gas entering the heat exchanger through an inlet connection 46 passes into interspaces 47 between individual ceramic elements 41. These interspaces are subdivided into smaller interstices by sheet members 48 which all are secured to an upper supporting plate 49. Sheet members 48 terminate at the interval from the lower connecting bricks 44. The exhaust gas travels through all interstices 47 over a path indicated by the arrows and leaves the heat exchanger 40 through a discharge connection 53. The discharge opening for discharging the air being heated is designated by the reference character 54. Behind the heat exchanger 40 can be provided an air compensation chamber 55 in which fresh air can be mixed with the room air to be heated.

Figure 6:
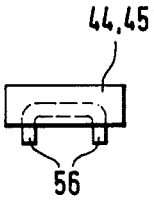
FIG. 6 is a side view of the joint building block with connecting passages for air.

The lower and upper connecting bricks 44 and 45 are provided with plug-in tube connections 56 shown in FIG. 6. Smaller connecting bricks are also provided, which extend respectively between the openings or passages 52 of two neighboring ceramic plates 51. Thereby interspaces are formed, between which the exhaust gas can pass. Soot and dust-collecting chambers 57 are provided at the bottom of the housing of the heat exchanger below the interstices 47. Chambers 57 which are normally closed can be open for cleaning in any suitable manner. The housing of the heat exchanger 40 is also provided in the side wall thereof with a non-illustrated opening with the respective door, through which ceramic plates 41 can be interchanged.

FIG. 4 shows a heat exchanger 50 which is similar in construction to that depicted in FIG. 3. Ceramic plates 51, one of which is shown in FIG. 4*a*, and having air passages 52, are also vertical and spaced from each other. These plates 51 are, however narrower than ceramic plates 41 and are spaced from each other at intervals 58 which are smaller than those of plates 41. The connection between the openings of passages 52 of each two neighboring plates 51 is obtained by individual plug-in heads 59 having plug-in tube pieces 60 through which the exhaust gas flows from one interspace 58 into the next interspace. The plug-in heads 59 are formed by hollow bars which prevent travel of the exhaust gases alternatingly through the lower or the upper ends of ceramic plates 51.

Ceramic plates 41 and 51 of heat exchangers 40 and 50, respectively are at their both opposite sides provided with a coating or layer 51 formed of a SOx-adsorbing material, for example a lime-containing mass. After the saturation of this layer with sulfur compounds of the exhaust gas can ceramic plates 41, 51 be removed from the heat exchanger and regenerated in alkaline liquid. A coating of the plates with a new layer of the material adsorbing sulfur compounds is also conceivable.

Figure 5:
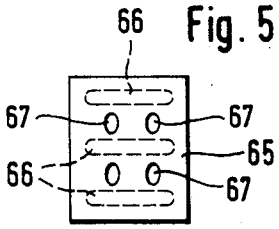
FIG. 5 is a top plan view of the modified building block of the heat storage-insert member, in which passages for flue gas and for air to be heated are provided.
Figure 7:
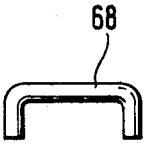
FIG. 7 is a side view of a plug-in tube bend for connecting two passages for air to each other in the building block similar to that of FIG. 5.

FIG. 5 shows a top plan view of the block or brick 65 for the heat storage insert member of the heat exchanger. Slit-shaped through passages 66 for exhaust gas and round through passages 67 for air or water or other heat-removing medium are formed in the brick 65. The latter can be manufactured, for example from sand-lime brick, in which the walls forming the round through passages 67 can be covered with air-and water-permeable coat or layer. The building blocks or bricks 65 can be tightly packed one after another and the connection between the round passages 67 of the neighboring bricks can be obtained by means of plug-in tubes 68 according to FIG. 7, provided with non-illustrated suitable conventional sealings.

It is to be noted that the total cross-sectional area of all passages for exhaust gas in the heat storage member in each embodiment is greater than the diameter of each respective inlet opening 13, 13', 46.

It will be understood that each of the elements described above, or two or more together, may also find a useful application in other types of heat exchangers differing from the types described above.

While the invention has been illustrated and described as embodied in a heat exchanger, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat exchanger for a furnace using sulfur-containing fuel, comprising a housing having an inlet for feeding hot exhaust gas into the housing and an outlet for discharging the exhaust gas from the housing; said housing including passages for passing a fluid medium therethrough, said fluid medium receiving heat from the exhaust gas and conducting said heat; at least one interchangeable heat storage insert positioned in said housing for storing and yielding heat received from the exhaust gas; said inlet being connected to an exhaust gas source and having a cross-sectional area, said heat storage insert being assembled of a plurality of individual blocks combined into a structural system and comprised, at least at surfaces thereof loaded with the exhaust gas, of a material which absorbs sulfur compounds are relatively low temperatures, said insert having a plurality of through passages for passing the exhaust gas therethrough, said through passages having a total cross-section area which is greater than the cross-sectional area of said inlet, said insert being positioned in said housing below said passages with the fluid medium receiving heat from the exhaust gas and before said passages in the direction of passing of the hot exhaust gas in said housing.

2. The heat exchanger as defined in claim 1, wherein said heat storage insert is coated in the region of said passages with said material which adsorbs sulfur compounds of the exhaust gas at relatively low temperatures.

3. The heat exchanger as defined in claim 1, wherein said fluid medium is water.

4. The heat exchanger as defined in claim 1, wherein said fluid medium is air.

5. The heat exchanger as defined in claim 1, wherein said heat storage insert has a surface and a filter layer on said surface, said filter layer additionally adsorbing the sulfur compounds of the exhaust gas and filtering a dust portion of the exhaust gas passing through said passages.

6. The heat exchanger as defined in claim 1, wherein said individual blocks are formed of various materials which absorb sulfur compounds at relatively low temperatures.

7. The heat exchanger as defined in claim 1, wherein said heat storage insert is assembled from bricks having hollows.

8. The heat exchanger as defined in claim 7, wherein each of said bricks is formed with said passages for the exhaust gas and with additional passages for the fluid medium receiving heat from the exhaust gas and conducting said heat.

9. The heat exchanger as defined in claim 8, further including plug-in connecting bridge elements for connecting individual blocks to each other.

10. The heat exchanger as defined in claim 9, further including a dust collecting chamber formed at a bottom of said housing.

11. The heat exchanger as defined in claim 7, further including a dust collecting chamber formed at a bottom of said housing.

12. The heat exchanger as defined in claim 1, wherein said bricks are made of clay.

13. The heat exchanger as defined in claim 1, wherein said bricks are made of sand-lime brick.

14. The heat exchanger as defined in claim 1, wherein said bricks are made of gas concrete.

15. The heat exchanger as defined in claim 1, wherein said bricks are made of pumice.

16. The heat exchanger as defined in claim 1, wherein said bricks are made of expanded clay.

17. The heat exchanger as defined in claim 1, wherein said bricks are made of crushed limestone.

18. The heat exchanger as defined in claim 1, wherein said bricks are made of gas concrete and pumice and expanded clay and crushed limestone.

19. The heat exchanger as defined in claim 1, wherein said blocks are made of bricks formed of a material adsorbing mineral acid steam and dust portions from the exhaust gas.

20. The heat exchanger as defined in claim 1, wherein said means containing fluid medium are tube means.

* * * * *